US007753364B2

(12) United States Patent
Lyga et al.

(10) Patent No.: US 7,753,364 B2
(45) Date of Patent: Jul. 13, 2010

(54) METHOD TO ACCOMMODATE A LARGE CAPACITY OF SHEETS IN A FEEDER MECHANISM

(75) Inventors: Thomas M. Lyga, Southbury, CT (US); James A. Salomon, Cheshire, CT (US); James A. Fairweather, Milford, CT (US); Norman R. Lilly, Monroe, CT (US); Anthony W. Chiappetta, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 102 days.

(21) Appl. No.: 11/786,877

(22) Filed: Apr. 13, 2007

(65) Prior Publication Data

US 2007/0284807 A1 Dec. 13, 2007

Related U.S. Application Data

(60) Provisional application No. 60/795,690, filed on Apr. 28, 2006.

(51) Int. Cl.
*B65H 1/08* (2006.01)

(52) U.S. Cl. ..... 271/127; 271/157

(58) Field of Classification Search ..... 271/136, 271/127, 147, 152, 157

See application file for complete search history.

(56) References Cited

U.S. PATENT DOCUMENTS

| | | | | |
|---|---|---|---|---|
| 4,319,740 | A | | 3/1982 | Ulseth |
| 4,667,949 | A | * | 5/1987 | Goodwin et al. ..... 271/207 |
| 5,100,122 | A | | 3/1992 | Noda et al. |
| 5,292,117 | A | | 3/1994 | Takagi et al. |
| 6,000,689 | A | | 12/1999 | Furuki et al. |
| 6,988,723 | B2 | | 1/2006 | Kitami et al. |
| 7,267,335 | B2 | | 9/2007 | Kubo |

* cited by examiner

*Primary Examiner*—Patrick Mackey
*Assistant Examiner*—Michael C McCullough
(74) *Attorney, Agent, or Firm*—Steven J. Shapiro; Angelo N. Chaclas

(57) ABSTRACT

The sheet capacity of a pivoting feed head is combined with a complimentary pivoting design for the paper tray lift, such that a large total capacity of sheets is attained within a compact space, while allowing the lifting mechanisms to be located outside of the perimeter of the paper tray.

10 Claims, 3 Drawing Sheets

METHOD TO ACCOMMODATE A LARGE CAPACITY OF SHEETS IN A FEEDER MECHANISM

This Application claims the benefit of the filing date of U.S. Provisional Application No. 60/795,690 filed Apr. 28, 2006, which is owned by the assignee of the present Application.

FIELD OF THE INVENTION

The invention relates generally to sheet folding and inserting machines, and more particularly to, a method to expand the capacity of a sheet feeder.

BACKGROUND OF THE INVENTION

In most paper handling equipment (such as: printers, copiers, facsimile machines, mailing machines, inserters, etc.) there is an apparatus for repeatedly feeding sheets from a supply or stack of sheets. Paper handling equipment is typically characterized by the functions it performs and the different types of sheets (cut copy or print sheets, original sheets, envelopes, post cards, checks, etc.) which it operates on. Generally, it is desirable to remove a single sheet from the stack and thereafter perform one or more functions on the sheet. The process of removing an individual sheet from the stack is commonly referred to in the industry as singulation or separation and the apparatus which performs this function is commonly referred to as a sheet feeder, singulator or separator. As the singulation process is repeated, a stream of individuals sheets is created. In this manner, a high degree of automation is achievable.

The efficiency of the sheet feeder is measured by: (1) its ability to consistently singulate and feed sheets from a stack without producing misfeeds; and (2) the speed at which the sheet feeder operates. One type of common misfeed to be avoided is a multi-feed which occurs when two or more sheets are removed from the stack and fed downstream together. This causes problems for the paper handling equipment, such as jams, which often require operator intervention to correct. Another type of common misfeed is a stall which occurs when the sheet feeder fails to feed any sheet at all. Therefore, it is desirable to have the sheet feeder operate within a processing window between stalls and multi-feeds where only single sheets are fed downstream.

Additionally, it is desirable to have the sheet feeder operate at high speed so that overall throughput of the paper handling equipment is achieved. Thus, a reliable and fast sheet feeder results in more efficient and cost effective paper handling equipment. However, increasing the speed of the sheet feeder often has the resulting negative consequence of increasing the likelihood of misfeeds. Additionally, the problem of misfeeds is complicated by a number of other factors. For example, static electricity, adhesion/cohesion and frictional drag between the sheets all act to generate a tendency for the sheets to remain together and resist singulation.

In addition to the factors above space is usually at a premium, thus it is desirable to achieve the maximum capacity of a sheet feeder given a fixed space. Multiple existing sheet feeders employ an elevator or other lift mechanism to increase the capacity of the feeder. Such mechanisms support the stack of sheets and advance the sheets to the feeder based on a demand signal from the feed system. It is also advantageous to design the lift mechanism so the lift mechanism can be de-coupled from the paper tray which enhances the service and manufacture of the feed system. It is also desirable to provide adequate user access for reloading the feed system with sheets. Existing feeders typically utilize a linear lift mechanism which require that the components and structure encompass the paper tray, which limits access and can prohibit the decoupling of the tray assembly from the lift mechanism.

SUMMARY OF THE INVENTION

This invention overcomes the disadvantages of the prior art by combining the sheet capacity of a pivoting feed head with a complimentary pivoting design for the paper tray lift, such that a large total capacity of sheets is attained within a compact space, while allowing the lifting mechanisms to be located outside of the perimeter of the paper tray.

In the invention described herein a portion of the feed capacity is achieved through the pivoting of the feed head. When the feed head has exhausted the capacity enabled by its pivoting motion a demand signal from the feed system initiates the advancement of the paper lift mechanism. The lift mechanism pivots about an axis parallel to the feed head's pivot axis. The direction of the feed head is descending to feed from the stack and it's rotation about the pivot is counter clockwise. The direction of the tray to advance sheets to the feed head replenish the stack is counter clockwise in this configuration. It would be obvious to one skilled in the art that the arrangements of the feed head and tray lead to the rotation directions described herein and other compatible configurations may be achieved.

The lift mechanism employs sensors to detect the states of the feed system, including the states of "tray fully lowered," "tray fully lifted" and "feeder requires additional sheets". The invention enables the user access to the tray for the purpose of loading and jam clearance by configuring the majority of the lift mechanism to one end of the tray.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PRESENT INVENTION

Figure 1:
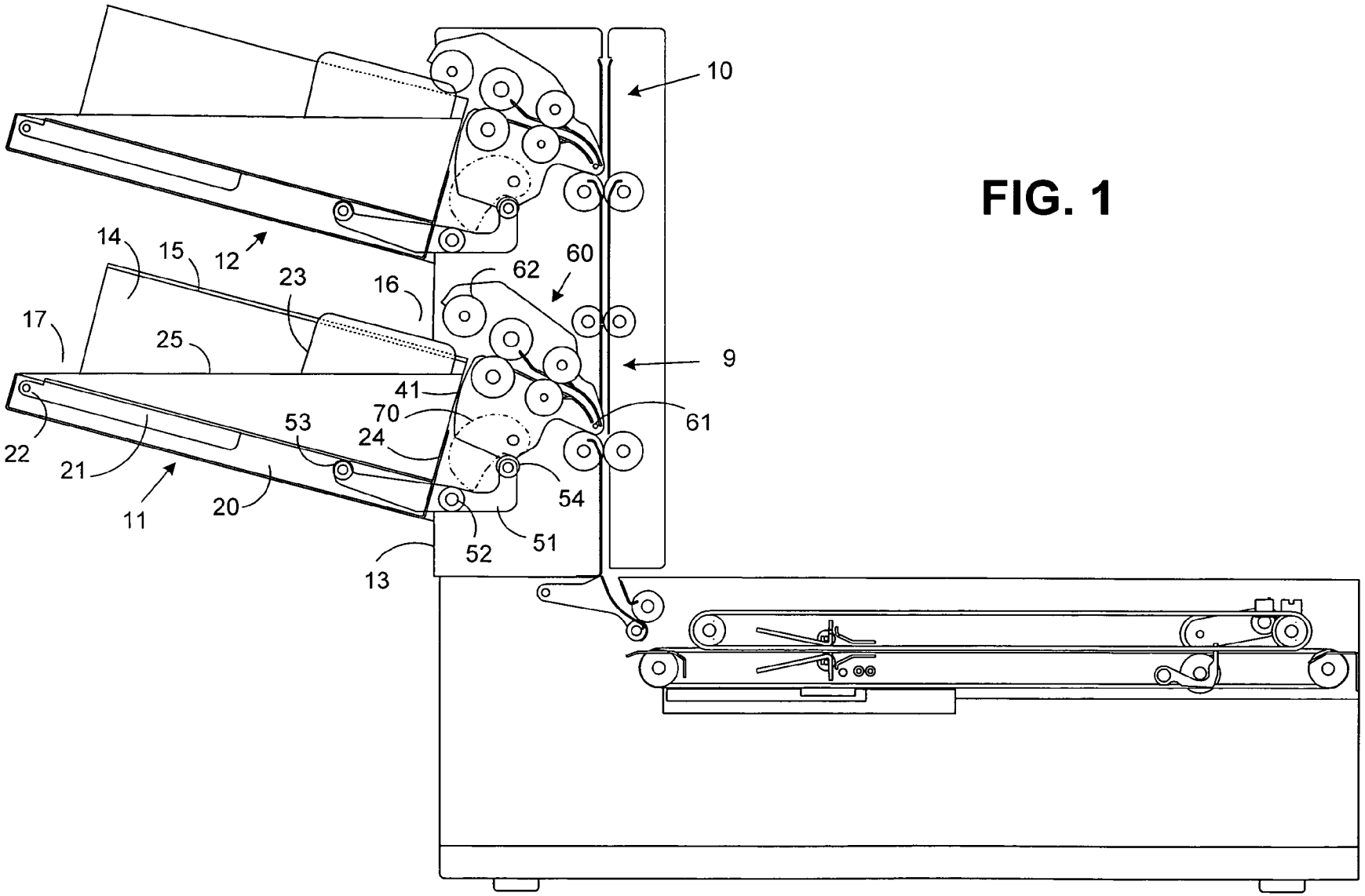
FIG. 1 is a drawing of a two feeder high capacity tray system showing tray and feed head arrangements.

In describing the present invention, reference is made to the drawings, wherein similar reference numerals in FIG. 1 designate similar elements in the various views.

In FIG. 1 the pivoting feed head is shown in a two feeder tower arrangement. Each feeder has a pivoting tray mechanism and a tray lift mechanism. The lift mechanism as shown in the upper feeder is fully lowered and the feed head nudger rests on the stack of sheets. Sheets may be paper sheets, envelopes, inserts made of paper or other materials, booklets, etc. The feed head is free to pivot counter clockwise and feed sheets from the stack as demanded by the control system. The lower feeder is shown in a configuration in which the tray lift mechanism has communicated through a linkage to lift the feed head off the stack of sheets. The configuration shown enables easy user loading of the tray and is made possible by the co-location of the tray lift mechanism and the feed head in the feeder tower.

Referring now to the drawings in detail and more particularly to FIG. 1, feed system 10 is shown in a ready to feed paper state while feed system 9 is shown in a ready to load paper state. The reference characters 11 and 12 respectively represent a lower feed tray assembly and an upper feed tray assembly of feed systems 9 and 10. Feed tray assembly 11 has the same components as feed tray assembly 12. Feed tray assembly 11 includes a base 20 which is attached to feed tower 13. Tray assembly 11 also contains a pivoting paper support 21 which pivots about an axis 22. Axis 22 is perpendicular to the orientation of FIG. 1. Assembly 11 also contains paper guides 23, i.e., adjustable side walls, which locator paper 14 along axis 22. Paper guides 23 cover less than one half the length of tray assembly 11, which facilitates the loading of paper 14 into the tray load end 17. The paper 14 is shown resting on paper support 21 and is aligned against a tray loading surface 24 and a feed loading surface 41.

The tray assembly 11 contains a fixed cover 25 which slopes downward from the tray feed end 16 to the tray load end 17.

Figure 2:
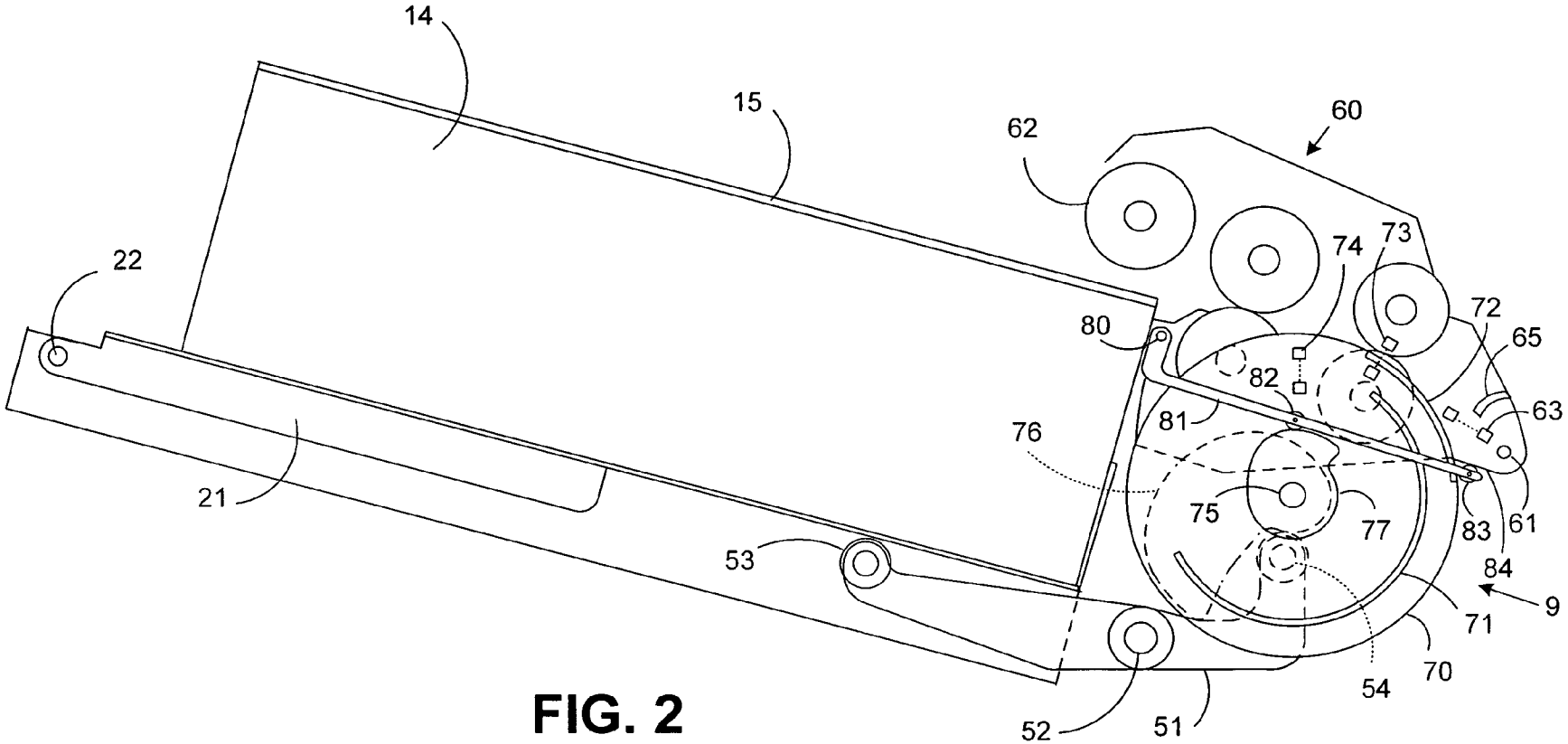
FIG. 2 is a drawing of the tray lift mechanism showing the tray fully retracted, and loaded to a full capacity with sheets.

FIG. 2 is a drawing of the feed system in a configuration equivalent to that of the upper feeder shown in FIG. 1.

The paper support 21 is lifted by a paper lift arm 51 that pivots about an axis 52 that is perpendicular to the orientation of FIG. 1. As the paper lift arm 51 is rotated clockwise about the axis 52, the pivoting paper support 21 is lifted upward by the rolling bearing lift member 53 of arm 51. The articulation of arm 51 occurs via the paper support life cam surface 76 thru the cam lift member 54 of arm 51.

The head life arm 81 pivots about an axis 80 and is displaced by the feed cam lift surface 77 when the cam assembly is rotated. The head life arm 80 contains a roller 83 that rotates against a roller surface 84 of feed head 60. Roller 83 displaces feeder 60 about an axis 61 lifting feed nudger 62 off of the paper sheet 15 permitting simply loading of paper 14 into feed tray assembly 12.

The feed head 60 is connected to feed tower 13 through a pivot 61, which is perpendicular to the orientation of FIG. 1. The head 60 rotates about pivot 61 in a counterclockwise direction until the feed nudger 62 comes in contact with paper 15. The feed head 60 singulates paper sheet 15 from the top of the paper stack 14. As each paper sheet 15 is feed from stack 14, the head 60 pivots by an incremental amount to restore the feed nudger 62 to a state of contact with the paper sheet 15.

When a number of successive paper sheet 15 singulations have occurred, the head 60 rotates such that the rib 65 blocks sensor 63 and causes a state change. The state change signals cam assembly 70 to advance which causes paper lift arm 51 to raise paper support 21, which raises the paper stack 14, which lifts the head 60 through the contact between paper stack 14 and feed nudger 62. When the head 60 is raised the sensor 63 changes state and stops the advancement of cam assembly 70.

Cam assembly 70 has an inner segment 71 and an outer segment 72. The segments 71 and 72 pass through two optical sensors 73 and 74. as cam 70 rotates around the cam axis 75, the segments 71 and 72 are located with a specific angular timing relationship to the paper support lift cam surface 76 and the feed cam lift surface 77. The angular timing arrangement produces sensor transitions at specific points of system control activity such as "head fully lifted", "tray support fully lifted", feed head fully pivoting" as respectively shown in FIGS. 1, 3 and 2. The foregoing allows sensors 73 and 74 to sense the position of cam surfaces 76 and 77.

Figure 3:
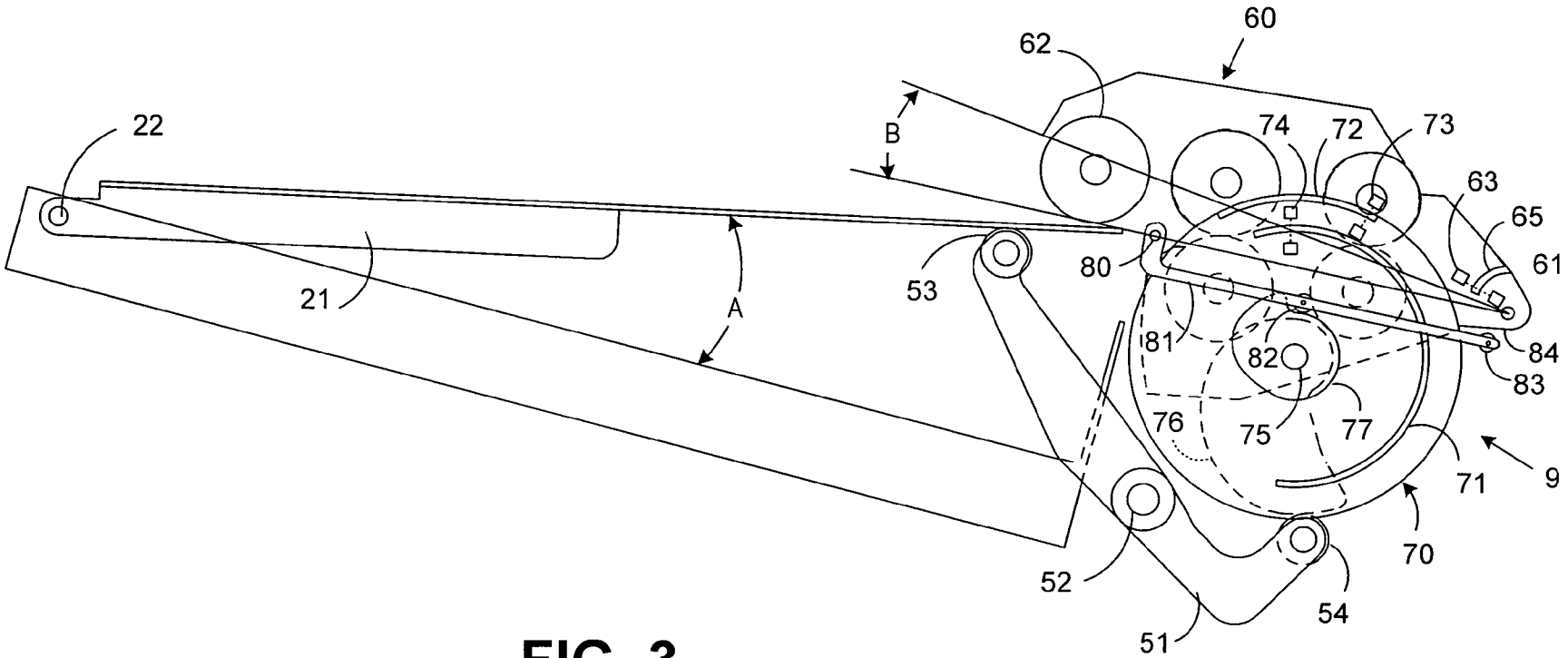
FIG. 3 is a drawing of the feed system 9 in the configuration of a empty tray.

FIG. 3 shows when the feed system 9 in the configuration of a empty tray. The paper support 21 is lifted by the paper lift arm 51 and the paper support 21 rotates about the axis 22 until all of the sheets in the stack 14 (FIG. 1) have been depleted. When the paper support 21 has advanced to a maximum counter clockwise position and the feed head 60 comes to rest at a maximum counter clockwise position the full capacity of the feed system 9 is utilized.

The total angular movement A of paper support 21 with respect to the base 20 of tray assembly 11 is between 0 degrees and 60 degrees with a typical angular motion of 0 degrees to 25 degrees. The feed head 60 undergoes a similar angular displacement B between 0 degrees and 50 degrees with a typical angular motion between 0 degrees and 20 degrees.

The above specification describes a new and improved method to expand the capacity of a sheet feeder. It is realized that the above description may indicate to those skilled in the art additional ways in which the principles of this invention may be used without departing from the spirit. Therefore, it is intended that this invention be limited only by the scope of the appended claims.

What is claimed is:

1. A device for feeding sheets to a feeder, the device comprising;

a tray assembly containing sheets, wherein the sheets rest on a pivoting support; and the tray assembly has a tray having a feed sheet end and a tray load end; a base and a fixed cover that slopes downward from the tray feed end to the tray load end;

a feed assembly that singulates the sheets, wherein the feed assembly pivots on an axis parallel to the pivoting support;

a linkage mechanism that couples an angle of a pivoting support motion of the tray assembly to a pivoting motion of the feed assembly so that sheets may be presented by the pivoting support to the feed assembly so that a capacity of sheets in the device exceeds a capacity of the sheets in the tray assembly and a capacity of the sheets in the feed assembly;

wherein the linkage mechanism comprises:

a lift arm that lifts the tray;

a lift arm cam;

a first cam follower connecting the lift arm to the lift arm cam;

a motor which drives the lift arm cam;

a feed assembly cam which lifts the feed assembly; and a second cam follower connecting the feed assembly to the feed assembly cam; so that the motor drives the feed assembly cam.

2. The device claimed in claim 1, wherein the pivoting support pivots about an angle between zero degrees and sixty degrees.

3. The device claimed in claim 1, wherein the tray assembly comprises: adjustable side walls.

4. The device claimed in claim 3, wherein the adjustable side walls cover less than one half of the tray length so that sheets may be loaded into the tray.

5. The device claimed in claim 3, wherein the adjustable side walls of the tray are sloped downward from the tray feed end to the tray load end.

6. The device claimed in claim 1, wherein the linkage mechanism further comprises:

a sensor that senses the angle of the feed assembly.

7. The device claimed in claim 1, wherein the linkage mechanism further comprises:

a sensor that senses the position of the lift arm cam.

8. The device claimed in claim 1, wherein the linkage mechanism further comprises:

a sensor that senses the position of the feed assembly cam.

9. The device claimed in claim 1, wherein a pivoting sheet support may be lowered to allow the sheets to be loaded into the tray assembly.

10. The device claimed in claim 1, wherein the feed assembly is raised to allow the sheets to be loaded into the tray assembly.

* * * * *